US008082090B2

(12) United States Patent
Kernwein et al.

(10) Patent No.: US 8,082,090 B2
(45) Date of Patent: Dec. 20, 2011

(54) METHOD AND DEVICE FOR OPERATION OF THE GLOW PLUGS OF A DIESEL ENGINE

(75) Inventors: Markus Kernwein, Bretten-Bueching (DE); Andreas Bleil, Ludwigsburg (DE); Olaf Toedter, Walzbachtal (DE); Helmut Mueller, Hessigheim (DE); Odd Peters, Bietigheim-Bissingen (DE)

(73) Assignee: Beru AG, Ludwigsburg (DE)

( * ) Notice: Subject to any disclaimer, the term of this patent is extended or adjusted under 35 U.S.C. 154(b) by 18 days.

(21) Appl. No.: 12/200,187

(22) Filed: Aug. 28, 2008

(65) Prior Publication Data

US 2008/0319631 A1 Dec. 25, 2008

Related U.S. Application Data

(62) Division of application No. 11/469,990, filed on Sep. 5, 2006, now Pat. No. 7,431,004.

(30) Foreign Application Priority Data

Sep. 9, 2005 (DE) ..... 10 2005 043 016
Mar. 6, 2006 (DE) ..... 10 2006 010 194

(51) Int. Cl.
*F02D 45/00* (2006.01)

(52) U.S. Cl. ..... 701/102; 123/145 A

(58) Field of Classification Search ..... 701/113, 701/102, 106, 115; 219/270, 544, 490–492, 219/497; 316/264–266; 123/145 A, 145 R, 123/605, 179.6, 179.21; 73/114.62
See application file for complete search history.

(56) References Cited

U.S. PATENT DOCUMENTS

| | | | | |
|---|---|---|---|---|
| 4,162,669 | A | 7/1979 | Igashira et al. | |
| 4,607,153 | A * | 8/1986 | Ang et al. | 219/497 |
| 4,858,825 | A * | 8/1989 | Kawamura | 237/2 A |
| 4,862,370 | A | 8/1989 | Arnold et al. | |
| 4,984,905 | A * | 1/1991 | Amano et al. | 374/143 |
| 5,194,718 | A | 3/1993 | Reiser et al. | |
| 5,241,929 | A * | 9/1993 | Grassi et al. | 123/145 A |
| 5,724,932 | A | 3/1998 | Antone | |
| 6,009,369 | A * | 12/1999 | Boisvert et al. | 701/99 |
| 6,148,258 | A * | 11/2000 | Boisvert et al. | 701/99 |
| 6,483,079 | B2 * | 11/2002 | Sato et al. | 219/270 |
| 6,635,851 | B2 * | 10/2003 | Uhl | 219/270 |
| 7,002,106 | B2 * | 2/2006 | Toedter et al. | 219/270 |
| 7,188,597 | B2 | 3/2007 | Rodriguez et al. | |
| 7,234,430 | B2 | 6/2007 | Toedter et al. | |

(Continued)

FOREIGN PATENT DOCUMENTS

DE 31 23 471 A1 12/1982

(Continued)

*Primary Examiner* — Willis Wolfe, Jr.
*Assistant Examiner* — Johnny H Hoang
(74) *Attorney, Agent, or Firm* — Roberts Mlotkowski Safran & Cole, P.C.; David S. Safran

(57) ABSTRACT

A method and device for operation of glow plugs of a Diesel engine in which the type of glow plugs used is determined, by a parameter typical of the glow plugs, for example, the electrical glow plug resistance, being detected and evaluated. The detected values of the parameter typical of the glow plugs are compared with corresponding data for various types of glow plugs stored in the glow controller to determine the type(s) of glow plug(s) in the engine. After identification of the type(s) of glow plug(s), stored sets of parameters, which correspond to the type(s) of glow plug(s) determined, are likewise called upon to control the glow plugs.

19 Claims, 1 Drawing Sheet

U.S. PATENT DOCUMENTS

| | | | | |
|---|---|---|---|---|
| 7,258,112 | B1 * | 8/2007 | Ptak et al. | 123/685 |
| 7,315,110 | B2 | 1/2008 | Yoshida | |

FOREIGN PATENT DOCUMENTS

| | | | |
|---|---|---|---|
| DE | 37 20 683 | A1 | 1/1989 |
| DE | 37 37 745 | A1 | 5/1989 |
| DE | 19616651 | A1 | 10/1997 |
| DE | 19625823 | A1 | 1/1998 |
| DE | 100 25 953 | A1 | 12/2001 |
| EP | 0992680 | A1 | 4/2000 |
| WO | 2007/033825 | A1 | 3/2007 |
| WO | 2007/140922 | A1 | 12/2007 |

* cited by examiner

METHOD AND DEVICE FOR OPERATION OF THE GLOW PLUGS OF A DIESEL ENGINE

CROSS REFERENCE TO RELATED APPLICATION

This application is a divisional of commonly owned, co-pending U.S. patent application Ser. No. 11/469,990, filed Sep. 5, 2006.

BACKGROUND OF THE INVENTION

1. Field of the Invention

The invention concerns a method and a device for operation of the glow plugs of a Diesel engine.

2. Description of Related Art

It is known art to control, i.e., to supply with the appropriate glow current, the glow plugs of a Diesel engine by means of a glow control unit that is linked with the engine controller of the engine. The glow plugs of an internal combustion engine should, however, be controlled depending on their particular type, i.e., depending on whether, for example, one is dealing with steel or ceramic glow plugs, on the basis of different glow parameters.

In order to achieve optimisation, it was previously necessary and customary to specify the type of plug concerned for the glow control unit and/or the engine controller, so that the glow plugs could be controlled appropriately as a function of this specification.

During operation of the glow plugs, no dynamic differentiation between different types of plugs was previously possible, which was responsible for the disadvantage that, when the specification of the plug type was missing or incorrect, with a change of plug type, for example, the control of the glow plugs could not be effected in a proper manner.

Furthermore, it was previously not possible to analyze and diagnose the type of glow plug fitted to an internal combustion engine, in order to deliver an appropriate warning signal if, for example, a type of glow plug is identified after a glow plug change that is unsuitable for the type of internal combustion engine, or if types of glow plugs of various kinds are fitted to the internal combustion engine, and mixed operation is to be excluded.

SUMMARY OF THE INVENTION

In contrast, it is a primary object of the present invention to provide a method and device of the kind cited in the introduction, which are configured such that operation of the glow plugs can take place at all times in the manner suitable for the type of glow plug concerned.

This object is achieved in accordance with the invention by a method in which the type of glow plugs of the internal combustion engine is determined by detecting and evaluating a parameter typical of the glow plug, and the glow plugs are controlled as a function of the type of glow plug that has been determined in this manner.

With the method and device in accordance with the invention, the type of glow plugs that are fitted to the internal combustion engine is identified and the relevant information is made the basis of the control of the glow plugs.

Thus, in accordance with the invention, by means of the analysis of a parameter typical of the glow plug, for example, an electrical characteristic, such as the electrical resistance of the glow plug, and in particular, the resistance gradient in glow operation, and/or the resistance in the cold state, and/or the resistance in the hot state, or the capacitance, inductance, or a physical characteristic, such as the resonance frequency, the type of glow plug is identified in an initial phase, and the type identified is reported in each case via a signal to the glow control unit and/or engine control unit. If corresponding application parameters are stored in the engine controller, the appropriate parameter set for the type of glow plug identified is loaded and the control of the glow plugs is correspondingly adapted.

In this manner, with low voltage glow plugs, for example, excess current to individual low voltage glow plugs can be prevented. A faulty replacement of individual glow plugs, for example, in a workshop, can likewise be identified if the vehicle is being appropriately checked over by means of a diagnostics tester. These functions can even be obtained during the low power clocked heating-up procedure before the actual start-up of the internal combustion engine.

In the following, a particularly preferred example of embodiment of the invention is described in more detail with reference to the accompanying drawings.

DETAILED DESCRIPTION OF THE INVENTION

Figure 1:
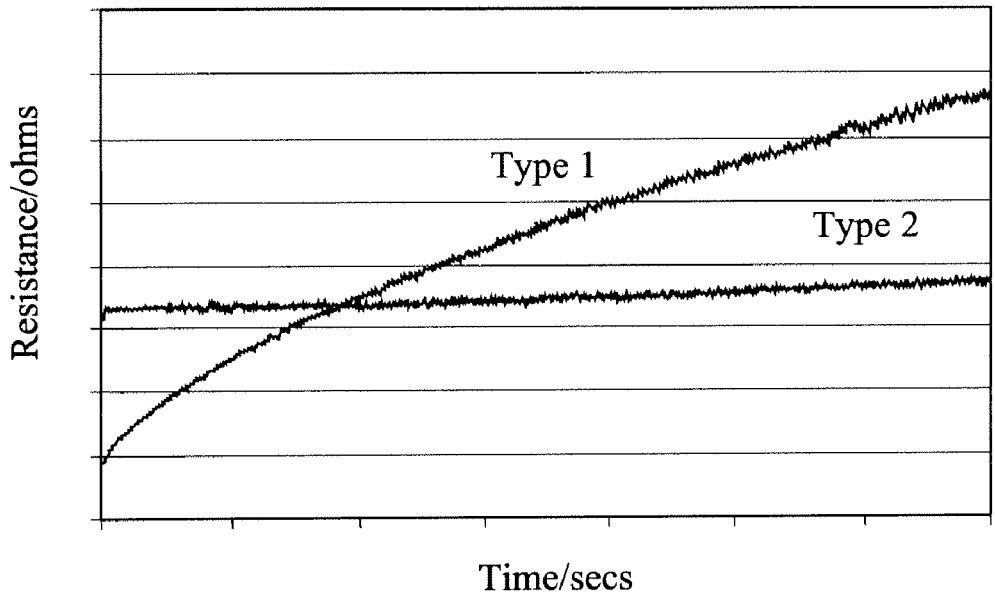
FIG. 1 is a graphic of the development with time of the glow plug resistance of two types of glow plug, e.g., a steel glow plug and a ceramic glow plug, at an operating voltage of 12 V.

As is shown in FIG. 1, different types of glow plugs 1, 2, have different characteristics, for example, ceramic glow plugs differ from steel glow plugs in that the resistance in the cold state, the resistance in the hot state and the resistance gradient during glow operation are clearly different. This is true also for the characteristic of the resistance during glow operation with clocked heating-up of the glow plugs.

By means of these differences, in accordance with the invention, identification of the type of glow plug fitted in each case is achieved at all times during operation of the internal combustion engine.

Figure 2:
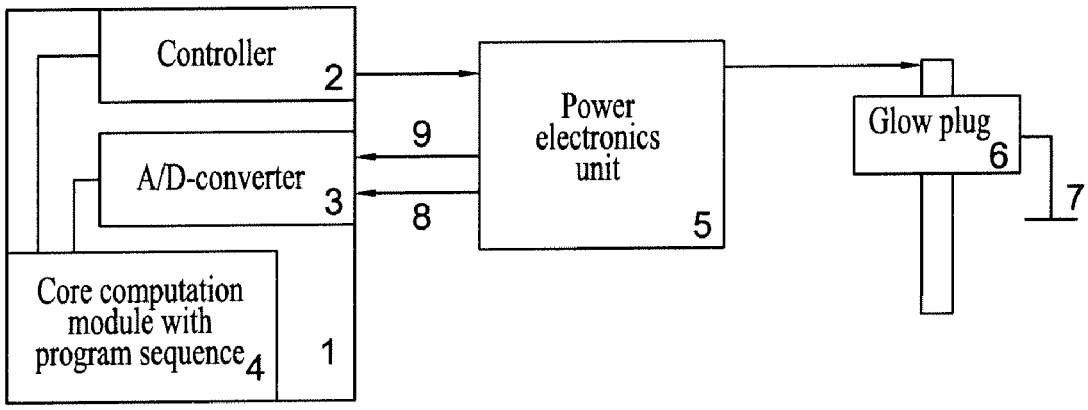
FIG. 2 shows a block diagram of a glow plug configuration for identification of the glow plug type.

FIG. 2 is a block circuit diagram of a corresponding glow system configuration in accordance with the invention.

A computer 1 has a core processing module 4 with a program sequence, an input module 3 for voltage and current values and also a controller 2 for a power electronics unit 5. The power electronics unit 5 is linked via signal lines with the input module 3 of the computer 1, the voltage to the glow plug being input via signal line 8 and a signal being input via line 9 corresponding to the current flowing through the power electronics unit 5 to the connected glow plug 6. The glow plug 6 has a grounding connection 7.

The working procedure in accordance with the invention is as follows:

During the operation of the glow plug, e.g., in the initial glow phase, in which the machine has not yet started up, or during operation of the internal combustion engine, the parameter typical of the glow plugs, namely the resistance of the glow plugs, is recorded and evaluated. For this purpose corresponding parameters are stored for the various types of glow plugs in the memory of the glow or engine controller, so that the type of glow plugs can be determined and identified by means of an appropriate comparison.

For example, the cold resistance is first determined in order to come to an initial decision as to whether one is dealing with a steel or ceramic glow plug as far as the type of glow plug is concerned. A rapid heating-up of the glow plugs can then start, and the resistance gradient during the rapid heating-up can be determined and used for a final identification of the type of glow plug.

This procedure has the advantage that the rapid heating-up process can be shortened or lengthened.

However, it is also possible to draw upon just the cold resistance, or the resistance gradient during heating-up, for identification of the glow plug type. The behavior of the resistance during a clocked heating-up procedure can also be drawn upon for purposes of differentiation.

In accordance with the invention, the identification of the type of glow plug can also take place before the start of operation of the complete glow system including the glow plug, in particular, it can take place at a pre-defined point in time in a pre-phase of the glow plug type identification. Here, instead of a resistance value, the capacitance, inductance, or resonance frequency of an oscillation circuit comprised of the capacitance and inductance of the glow plug, can be drawn upon as the parameter.

It has been shown that a secure manner of identification is possible by means of these parameters. This is then particularly suitable if the cold resistances of glow plugs in ceramic and metal designs are subject to large scatter, since then the various types of glow plugs can be differentiated very clearly from one another by means of the capacitive and inductive properties. Tests have demonstrated that the inductance, in particular, is a reliable identification characteristic. Thus, a steel plug with a glow winding has an inductance that is larger by a factor of 3 to 4 than that for a corresponding ceramic glow plug.

By means of a simple measurement of the electrical properties, in particular, the inductance, a reliable identification of the type of glow plug can thus be ensured.

Here, the measurement takes place in the initial phase at a defined point in time before the heating-up of the glow plug so that, even during the first glow plug heating-up procedure, the type-specific heating program can be used. After the glow plug has been identified, a corresponding parameter set for the identified glow plug type, which is stored in the glow controller or engine controller, is called up and loaded, and control of the glow plugs takes place with the called-up parameter set that belongs to the glow plug type identified.

Identification of the type of glow plug can take place individually for each glow plug, i.e., for each glow plug circuit, so that the individual glow plugs can be separately controlled according to the type identified. Also mixed operation from common identification and control of a group of glow plugs, as well as individual glow plugs, is possible.

In accordance with the invention, a differentiation of the glow plug type thus takes place, the type of glow plug identified is signaled to the controller, and a correspondingly matched parameter set is automatically selected, if appropriate applications data for the type of glow plug are stored in the controller.

In addition to the variant in which the application data are stored in the glow controller, i.e., in the glow control unit, there is also the variant in which these data are stored in the engine controller, i.e., in the engine control unit. If different types of plug are to be identified that can be fitted in a internal conversion engine, corresponding application data can be stored in both control units. In this case, the relevant control unit is sometimes the glow control unit and sometimes the engine control unit.

This has the advantage that the destruction of glow plugs by a controller by the use of parameters for the incorrect plug type is avoided, that an unfavorable combination of plug type and engine type can be identified, and that with a plug change, the type of the glow plugs newly introduced does not need to be communicated to the controller in each case, i.e., does not have to be specified to the glow control unit or the engine controller, which reduces the susceptibility to errors.

What is claimed is:

1. A method for operation of glow plugs in a Diesel engine, comprising the steps of determining what type of glow plugs are in the engine by detecting at least one of a physical and electrical characteristic of the glow plugs in the Diesel engine and evaluating the characteristics detected with respect to corresponding known glow plug characteristics of the determined type of glow plugs, and controlling operation of the glow plugs in a manner suitable for the type of glow plug that has been determined based upon the results of the detecting and evaluating steps.

2. The method according to claim 1, wherein the determining and controlling steps are effected individually and separately for each of the glow plugs of the internal combustion engine.

3. The method according to claim 1, wherein the determining and controlling steps are effected in common for all glow plugs of the engine.

4. The method according to claim 1, wherein the determining and controlling steps are effected in common for less than all of the glow plugs, and are effected individually and separately for the remaining glow plugs of the engine.

5. The method according to claim 1, wherein the determining and controlling steps are performed during on-going operation of the engine.

6. The method according to claim 1, wherein the determining step is performed during a glow plug identification phase ahead of an on-going operation of the internal combustion engine.

7. The method according to claim 6, wherein the determining step is performed during a glow plug type identification phase at a pre-defined point in time.

8. The method according to claim 5, wherein the characteristics of the glow plugs detected comprise is an electrical resistance of the glow plugs.

9. The method according to claim 8, wherein a cold resistance of the glow plugs is used as a parameter typical of the glow plugs.

10. The method according to claim 8, wherein a hot resistance of the glow plugs is used as a parameter typical of the glow plugs.

11. The method according to claim 8, wherein a resistance gradient in glow operation is used as at least one of the physical and electrical characteristics of the glow plugs that is detected.

12. The method according to claim 5, wherein a behavior of the resistance of the glow plugs during a clocked heating-up procedure is used as at least one of the physical and electrical characteristics of the glow plugs that is detected of the glow plugs.

13. The method according to claim 5, wherein an initial decision concerning the type of glow plug is first made using a cold resistance of the glow plugs, and subsequently, a final decision is made concerning the type of glow plug by an evaluation of a resistance gradient in glow operation.

14. The method according to claim 6, wherein the at least one of the physical and electrical characteristics of the glow plugs is an inductance of the glow plugs.

15. The method according to claim 6, wherein the at least one of the physical and electrical characteristics of the glow plugs is a capacitance of the glow plugs.

16. The method according to claim 6, wherein the at least one of the physical and electrical characteristics of the glow plugs is a resonance frequency of an oscillation circuit formed of a capacitance and inductance of the glow plugs.

17. The method according to claim 1, wherein said determining step is performed by comparing the at least one of the physical and electrical characteristics with specified data for various types of glow plugs.

18. The method according to claim 1, wherein the type of the glow plugs determined is transferred to the engine controller of the internal combustion engine.

19. The method according to claim 18, wherein a parameter set corresponding to the type of the glow plugs determined is automatically selected and drawn upon to control the glow plugs by the engine controller as a function of the type of the glow plugs determined.

* * * * *